US007634982B2

(12) United States Patent
Wilson

(10) Patent No.: US 7,634,982 B2
(45) Date of Patent: Dec. 22, 2009

(54) INTAKE MANIFOLD

(76) Inventor: Keith D. Wilson, 5842 NW. 41st La., Coconut Creek, FL (US) 33073

( * ) Notice: Subject to any disclaimer, the term of this patent is extended or adjusted under 35 U.S.C. 154(b) by 5 days.

(21) Appl. No.: 12/001,668

(22) Filed: Dec. 12, 2007

(65) Prior Publication Data

US 2008/0149060 A1 Jun. 26, 2008

Related U.S. Application Data

(60) Provisional application No. 60/874,328, filed on Dec. 12, 2006.

(51) Int. Cl.
*F02B 75/22* (2006.01)

(52) U.S. Cl. ..... 123/184.21

(58) Field of Classification Search ..... 123/184.21–184.61
See application file for complete search history.

(56) References Cited

U.S. PATENT DOCUMENTS 3,831,566 A 8/1974 Thomas
4,109,619 A * 8/1978 Morris ..... 123/184.56
4,279,224 A * 7/1981 Szabo et al. ..... 123/184.32
4,355,623 A * 10/1982 Graham ..... 123/585
4,872,424 A * 10/1989 Carnes ..... 123/184.32
5,501,192 A * 3/1996 Cutler ..... 123/336
5,505,170 A * 4/1996 Cutler ..... 123/184.34
6,161,513 A 12/2000 Lohr et al.
6,269,805 B1 * 8/2001 Wilson ..... 123/585
6,401,679 B1 6/2002 Self
7,021,263 B1 4/2006 Agnew et al.

* cited by examiner

*Primary Examiner*—M. McMahon
(74) *Attorney, Agent, or Firm*—Richard M. Saccocio

(57) ABSTRACT

An improved in intake manifold for a carbureted, vee type of internal combustion engine is comprised of at least two members, a fuel-oxidizer flow member and an isolator member. The flow member is removably connected to the isolator member. The isolator member is connected at a bottom surface to a vee valley of the internal combustion engine formed between opposing banks of cylinders. In a preferred embodiment, the flow member is sealingly split along a longitudinal axis of the engine. The isolation member isolates the flow member from the environment existing in the vee valley while sealing the vee valley. Engine coolant passages and a distributor shaft opening are provided within the isolator. Changing the flow member is accomplished without disturbing the vee valley sealing, the distributor setting, nor the engine cooling conduits.

18 Claims, 5 Drawing Sheets

INTAKE MANIFOLD

CROSS REFERENCE TO RELATED APPLICATIONS

This application is related to U.S. Provisional Application Ser. No. 60/874,328, filed on Dec. 12, 2006.

BACKGROUND OF THE INVENTION a) Field of the Invention

This invention relates in general to the field of improved performance for internal combustion engines, and in particular to methods and apparatus for providing an improved intake manifold for a carbureted engine.

b) Description of the Prior Art

It is advantageous for carbureted internal combustion engines, especially engines used in automobiles, to develop maximum power and torque throughout the revolutions per minute (RPM) range of the engine consistent with the amount of fuel used. Thus, for any given amount of fuel consumed by an internal combustion engine, it is advantageous to develop as much power as possible. The power and torque developed by a carbureted internal combustion engine is generally proportional to the amount of fuel mixture delivered to the cylinders of the engine. Normal aspiration simply relies on atmospheric pressure to supply the fuel-oxidizer mixture to the cylinders. Additional fuel-oxidizer can be input by the use of an exhaust driven turbine or by an engine driven supercharger. The mixture always includes air and at times an oxidation enhancer such as nitrous oxide. In general, in typical automobile carbureted engines, the mixing of the fuel and the oxidizer is accomplished by the carburetor which mixed fuel-oxidizer then flows through the intake valves of each cylinder where the fuel-oxidizer mixture is ignited by a spark plug causing the mixture to burn and expand which in turn causes the pistons move downward within a cylinder. The downward motion of the pistons during their power strokes apply a rotational force to a crank shaft. The crankshaft comprises the output shaft of the motor which of course when coupled to a drive shaft drives the wheels of the automobile.

It has been a continuing goal of engine and accessories manufactures to maximize the power output from a carbureted engine in relation to a given amount of fuel-oxider mixture burned within the engine. Why? For one thing, better fuel economy. Another reason is for race car purposes. A car that produces more power while burning a given amount of fuel will be able to go faster and win more races.

The amount of fuel-oxidizer mixture is only one factor that is used to maximize the power output from a carbureted internal combustion engine. Another factor comprises the mixing of the fuel and the oxidizer. In an ideal situation, each molecule of fuel is completely burned within the engine and such that the burning advances with the power stroke of the piston and not before or after.

Accordingly, a number of clever innovations have been invented and or developed with the intent to optimize the mixing of the fuel and the oxidizer and to minimize the flow restrictions as the mixture flows from the carburetor to the cylinders. For example, it has been found that a spacer between the carburetor outlet and the inlet to the intake manifold enhances the mixing of the fuel and the oxidizer. Another well known example is a process known a porting and polishing the internal configuration of the intake manifold to enhance the laminar flow of the fuel-oxidizer mixture by lessening pressure drop configurations or restrictions within the intake manifold. The spacer and the porting and polishing also serve, at least in part, to maintain the attempted optimal mixing of the fuel and the oxidizer. While successful to a degree, the advent of a spacer and the porting and polishing of an manifold have not provided the final chapter in drivers seeking more power and the government and auto manufacturers seeking better fuel economy.

In other words, better methods and apparatus are desired to provide for better mixing of the fuel and oxidizer, to maintain the better mixing within the intake manifold and into the cylinders of a carbureted internal combustion engine, and to deliver the better mixed fuel-oxidizer to each cylinder regardless of an individual cylinder's relative location to the outlet of the intake manifold.

The present invention accomplishes these goals.

SUMMARY OF THE INVENTION

The present invention comprises an improved intake manifold for use with a vee type of carbureted internal combustion engine that is made from at least two individual components comprising a spider and an isolator. The spider providing for the connection of a carburetor and if desired a spacer to the intake manifold and for delivery of mixed fuel and oxidizer to the engine's cylinders. The isolator providing for a functional interface between the spider and the "vee valley" of the engine. The vee valley being defined as the open portion of the engine block between the opposing banks of pistons and cylinders of the vee engine. As defined, the vee valley is open to sundry components of the engine including but not limited to crankshaft, the piston connecting rods, the cam shaft, the push rods, the distributor shaft, and the oil and water coolant passages. In general, in the prior art, the vee valley exposes the intake manifold to hot oil and hot water that is not conducive to optimal performance. In a preferred embodiment, the interfacing isolator portion of the inventive manifold, isolates the spider from this hostile environment and allows the spider to function independently to achieve peak performance. In one embodiment, the spider is split longitudinally and then sealing connected together to form a hermetically sealed spider. The split spider allows for attaining inherent porting and polishing, during the manufacturing process, of each bank of flow passages on either side of the vee engine prior to being joined. The isolator providing for isolation of the spider from the vee valley in general and in particular for isolating the spider from the thermal effects existing within the vee valley. The at least two piece intake manifold further provides for changing the spider to accommodate a different sized carburetor without disturbing the connections between the intake manifold and the openings and passages of the vee valley. In addition to the increased performance and interchangeability of the spider, the inventive manifold is simple to manufacture and virtually eliminates the need for manual porting and polishing.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis as a representative basis for teaching one skilled in the art to variously employ the present invention in virtually any appropriately detailed structure. Further, the terms and phrases used herein are not intended to be limiting; but rather, to provide an understandable description of the invention.

Figure 1:
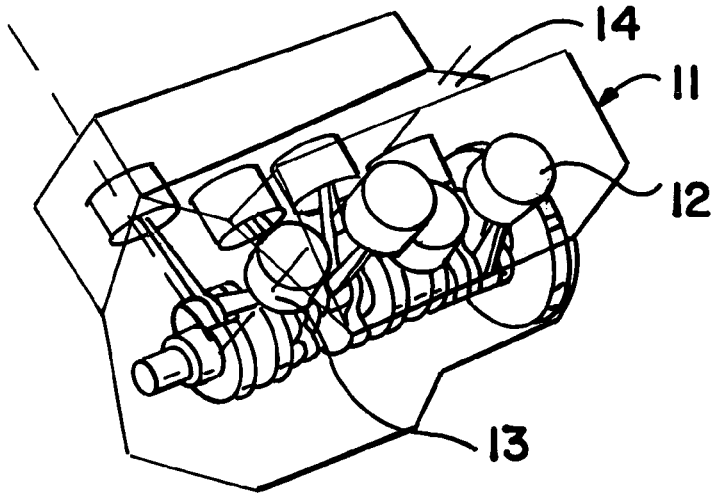
FIG. 1 PRIOR ART
FIG. 1 is a simplified schematic rendering of a prior art vee eight engine illustrating the general overall shape of the engine block and comprises the type of engine to which the present invention is adapted.

Reference is now made to the drawings accompanying this application. FIG. 1 is a schematic version of a typical prior art internal combustion engine 11 to which the present inventive manifold can be applied. Engine 11 is for example an eight cylinder engine of a vee type. The vee designation stems from the arrangement of four pistons 12 being located on each side of the engine and such that a vee configuration 13 forms between the two banks of pistons when viewed from the front of the engine. A vee type of engine is advantageous in that it allows for a shorter length as compared to for example an eight cylinder engine having all eight cylinder in a straight line. A vee eight engine is a very popular engine and generally is the choice of race car drivers, manufacturers, and owners, at least in the United States. The portion of the engine, between the opposing banks of pistons, or cylinders, for purposes of description herein is referred to as the vee valley 14 and is generally open to various internal components of the engine. Thus. the nomenclature "vee valley" is used herein only for purposes of referring to that particular portion of the engine 11 that normally lies under the intake manifold and between the cylinder banks. In general, the vee valley 14 is an opening in the engine block to which an intake manifold is attached. The intake manifold is not shown in FIG. 1.

For purposes of describing the preferred embodiment of the inventive manifold, it will be described as being applied to a carbureted, eight cylinder, vee type of engine where the intake ports of the engine are in the cylinder heads lying below the valve train and on the inside of the vee 13, and the valves are operated by an internal camshaft using push rods extending from the camshaft and up through the cylinder heads to open and close the intake and exhaust valves. However, the teachings herein can, with minor changes known to one with ordinary skill in the art, be applied to a vee engine having six, ten, twelve or even sixteen cylinders, which can be fuel injected into the manifold or directly into the cylinders and can further include an overhead cam configuration. In all of these engines, the intake ports are on the inside of the vee and the exhaust ports on the outside of the vee 13, and a vee valley 14 exists between the opposing banks of cylinders.

Accordingly, in a carburetor engine utilizing push rods, the vee valley 14 exposes a number of the engine components including but not limited to the push rods, the coolant water passages, the intake openings, the distributor shaft opening, the housing for the thermostat, and the lubricating oil passages to the underside of the intake manifold. Moreover, the valve valley is generally awash with lubricating oil which of course requires that various passages be sealed from the lubricating oil. In general such seals are accomplished by one or more gaskets that fit between the inlet manifold and the valve valley.

In this prior art, the intake manifold is usually a one piece component that includes an upper opening to which a carburetor is attached, and a set of interconnecting passages leading from the carburetor opening to each of the fuel inlet ports. The bottom portion of the intake manifold being sealingly attached to the vee valley such that various of the above mentioned openings are sealed from each other. The vee valley thusly exposes the portion of the intake manifold that seals the vee valley to the relatively hostile environment in the vee valley; and, therefore the conditions produced by the hostile environment hostile are transferred by conduction, radiation, convection, and or any other means to the fuel-oxidizer portion of the intake manifold. The transfer of the hostile environment conditions to the delivery portion of the intake manifold is needless to say detrimental to peak performance of the delivery function of the intake manifold.

The above simplified description of the prior art push rod, carburetor engine does not even begin to describe the intricate features and interactions of such an engine; thus, while the engine is very complicated, it has been in existence for many years and its use has been and still is so widespread that it has achieved a great deal of reliability. Still as noted above, the many different operating conditions such as the need for lubrication, the need for water and air cooling, emissions control, vacuum assists, power steering power brakes, air conditioning, etc, etc. each require their own optimal operating conditions which in general adversely affect the optimal operating conditions of the other components. In this regard, the performance of the intake manifold is just another component that must operate in conjunction with all of the other engine needs and components and still operate efficiently. Difficult as this may seem, the long time development of the vee type of internal combustion engine has managed to permit each engine need and component operation to exist in relative harmony and has achieved a remarkably reliable power source. However, as always, there exists the continued desire to extract the maximum amount of power from a carburetor engine while maintaining or even improving its reliability. Simply stated, fuel provides the power of an engine. Optimal fuel mixing and distribution to each cylinder and complete combustion (actually burning) of the fuel provide for optimal power with minimum fuel consumption. Such are the functions of the intake manifold. The present invention has been shown to greatly increase power output for a given amount of fuel consumption. Alternatively, the present invention has been shown to lessen the amount of fuel consumed while producing a given amount of power. The invention comprises a new and improved intake manifold for an internal combustion engine.

Figure 2:
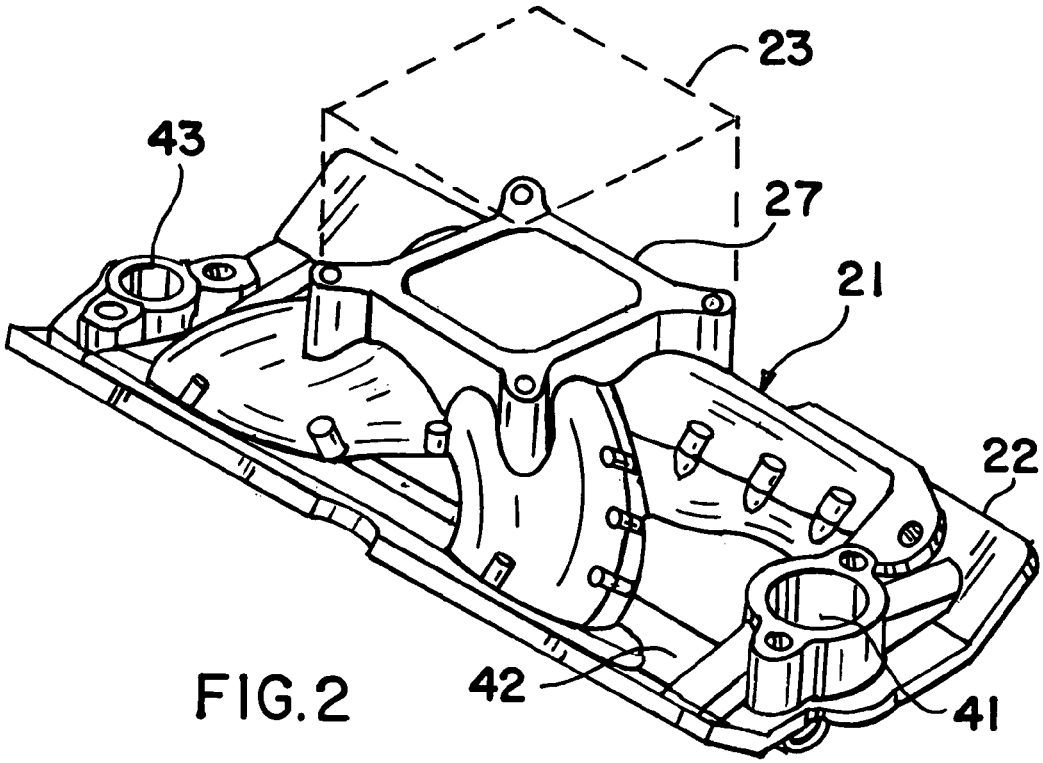
FIG. 2 is an isometric version of the assembled invention.

FIG. 2 illustrates one embodiment of the new and improved intake manifold 10. It is comprised of two major components, a spider 21 and an isolator 22. The isolator 22 is adapted to be sealing attached to an engine's vee valley 14. The spider 21 is adapted to be attached at one end to the isolator 22 and at the other end, to a carburetor and if used, a spacer, which is schematically shown in phantom as item 23. In one envisioned embodiment, the spider 21 can be manufactured in one piece, for example by molding, casting or machining. Each type of manufacturing process having its advantageous and of course disadvantageous. The spider 21 includes a flange 27 for attachment of a carburetor-spacer 23, and a plurality of internal passages or channels for flow distribution of a fuel-oxidizer mixture to the cylinders, or maximum power and optimal fuel combustion, smooth internal fuel passages are preferable. Further preferable are the sized and aligned outlets of the fuel-oxidizer passages relative to the inlet openings of fuel-oxidizer passages in the engine block that lead to the fuel inlet valves. Minimum flow disturbances within the internal passages, at these interfaces provide for the smooth transition of the fuel flow and help achieve maximum power. In common parlance, the accurate sizing of the outlet of the intake manifold to the inlet of the block is known as "porting". Generally and in the prior art, porting is accomplished by manual means which of course is expensive and time consuming. However, manual porting is not required with the inventive intake manifold. In common parlance, achieving smooth internal passages within the intake manifold is known as "polishing" and has been accomplished in the prior art again by manual means. Manual polishing is not required with the inventive intake manifold. The inventive construction of the intake manifold spider 21 allows for "porting and polishing" to be included in the manufacturing process, be it machining, casting, or molding.

FIG. 2 further illustrates the mating of the spider 21 with the isolator 22. As can be seen, a very efficient overall compact structure is achieved; yet, as will be more fully explained hereinafter, the unique construction allows each part to essentially function independently of the other, thereby allowing each component to be designed free of the interacting restraints normally associated with an intake manifold.

Figure 3:
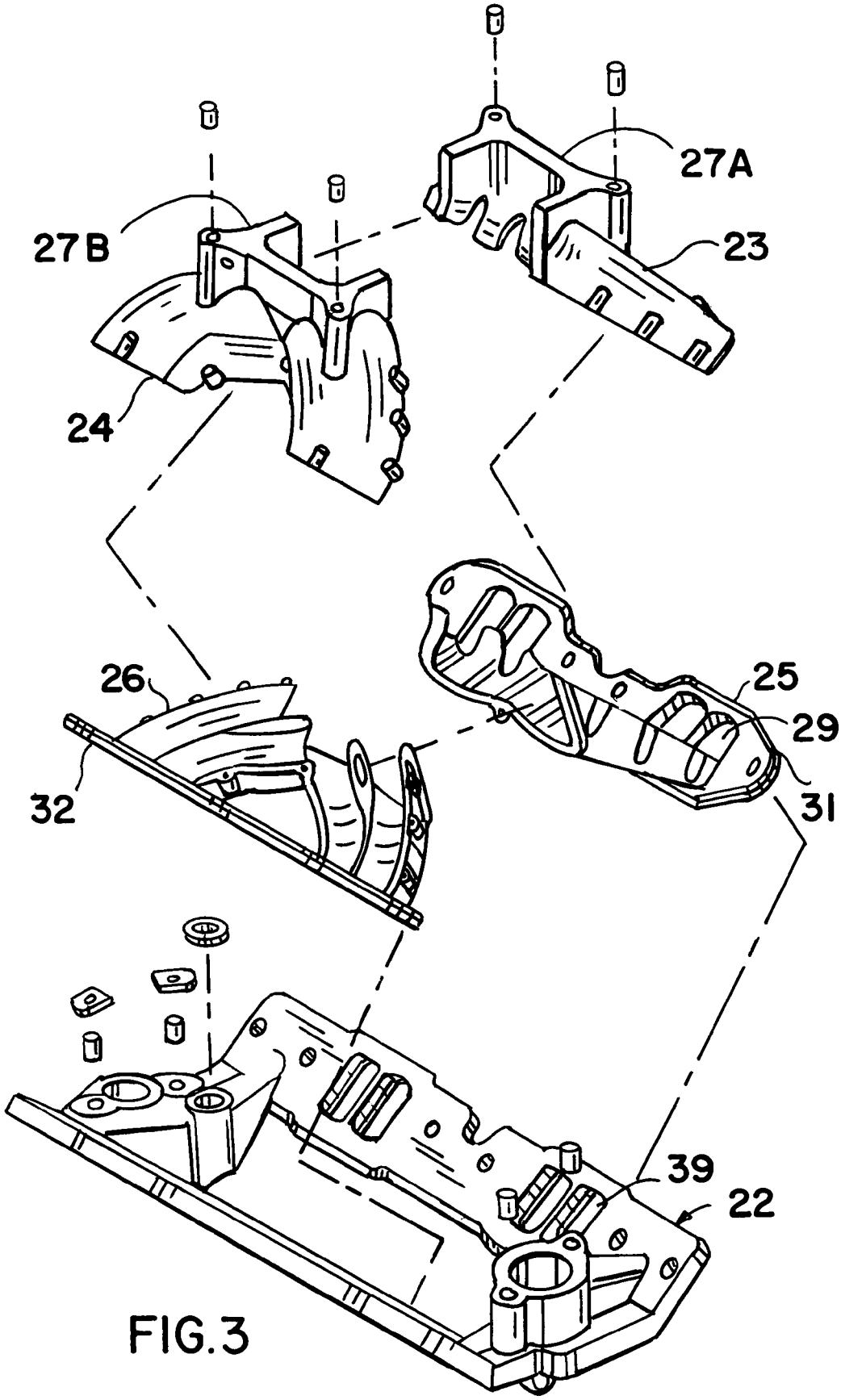
FIG. 3 is an isometric rendering of the unassembled components of the spider illustrating their arrangement when assembled.

FIG. 3 illustrates one embodiment of the construction of the spider 21 to achieve ported and polished internal passages within the spider 21. In this embodiment, the spider 21 is manufactured in four separate components or portions 23, 24, 25, and 26. Portions 23 and 25, when joined together, form the inlet passages to the cylinders on one side of the vee engine; portions 24 and 26, when joined together, form the inlet passages to the cylinders on the other side of the vee engine. Joining can be accomplished by any well known method such as bolting. Portions 23 and 24 each include one half of the carburetor boss or flange 27. Each of the separate portions 22-26 can be manufactured by molding, machining or even die casting, any one of which allows for smooth internal passages 28 and accurate sizing of the passages 28 and outlet ports 29. The outlet ports 29 for the bank of cylinders on one side of the engine are seen in portion 22 of FIG. 3. Although not seen in FIG. 3, the outlet ports for the other side of the engine are located in portion 26. Portions 25 and 26 include flange portions 31 and 32 that provide for connection to the isolator 22 which is more fully described hereinafter. When connecting portions 23-26, appropriate gaskets are used between each joint to assure a leak free joint. If for some reason, it is desired to modify one or more internal passages within the spider 21, it is a simple task to do so before the portions are joined together or even after the intake manifold has been installed and the auto test driven. Consistent with the ease of manufacturing the spider 21, portions 23 and 24 can be mirror images of each other, as can be portions 25 and 26. In order to assure correct alignment of the connecting portions 23-26 when being joined, alignment pins can be used. It is to be noted that the carburetor flange 27 can be made larger or smaller while maintaining the remaining physical dimensions of spider 21. In this manner, a larger or a smaller carburetor can be used by removing and replacing the spider 21 with one adapted for a different sized carburetor without removing the isolator 22 and therefore not disturbing the intricate sealing between the isolator 22 and the vee valley 14.

Figure 4:
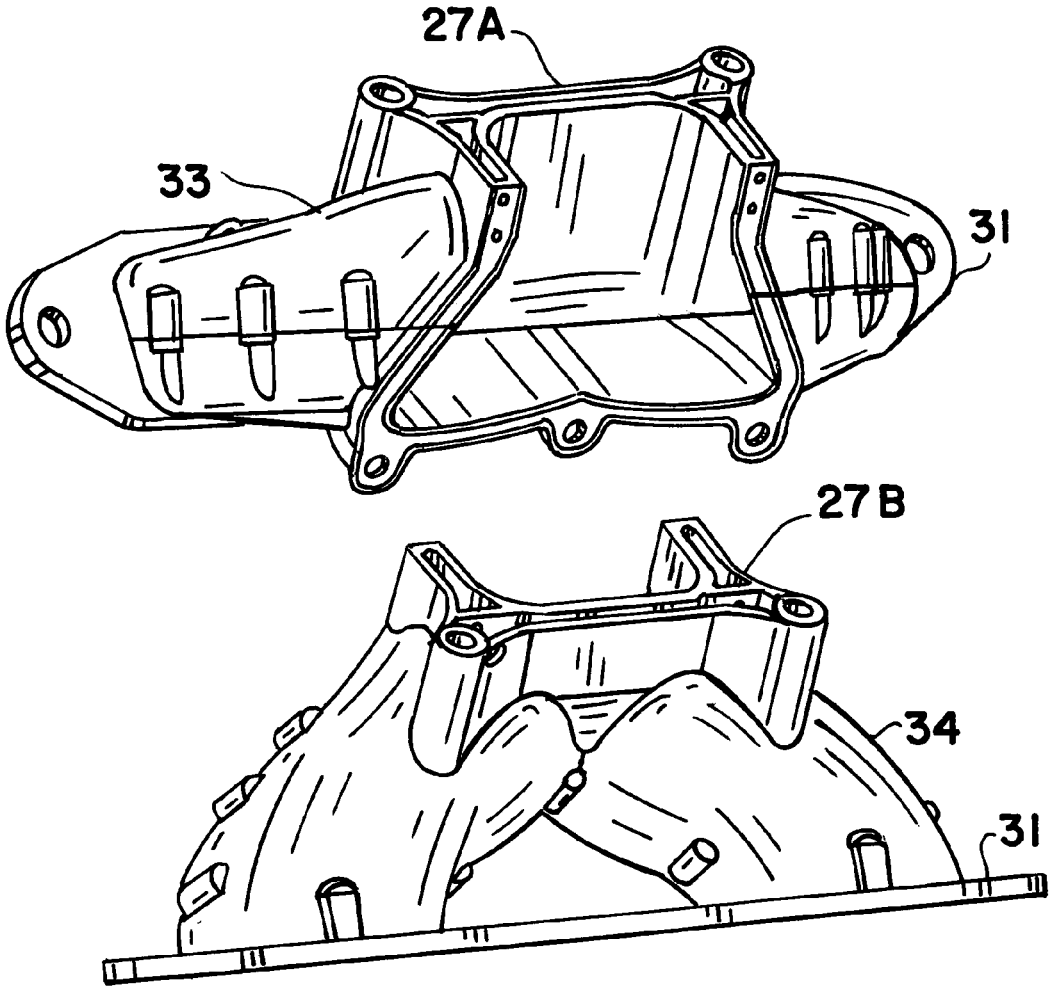
FIG. 4 is another isometric rendering of the spider illustrating partial assembly of the same.

As noted above, the four piece spider 21 can be made in two separate pieces. In this embodiment, portions 23 and 25 are made as a single component 33. Similarly, portions 24 and 26 can be made as a single component 34, see FIG. 4. Each separate component forming one half of the spider 21. Upon connecting the two separate components, for example, by bolting, the full spider 21 is formed. Of course, other construction variations are possible, for example, upper portions 23 and 24 can be made as a single piece and portions 25 and 26 can be made in separate pieces or as a single piece. However configured before connection of the components of the spider 21, the intent is to achieve a unitary and leak free single spider 21 that can be removed as a single unit from isolator 22.

Figure 5:
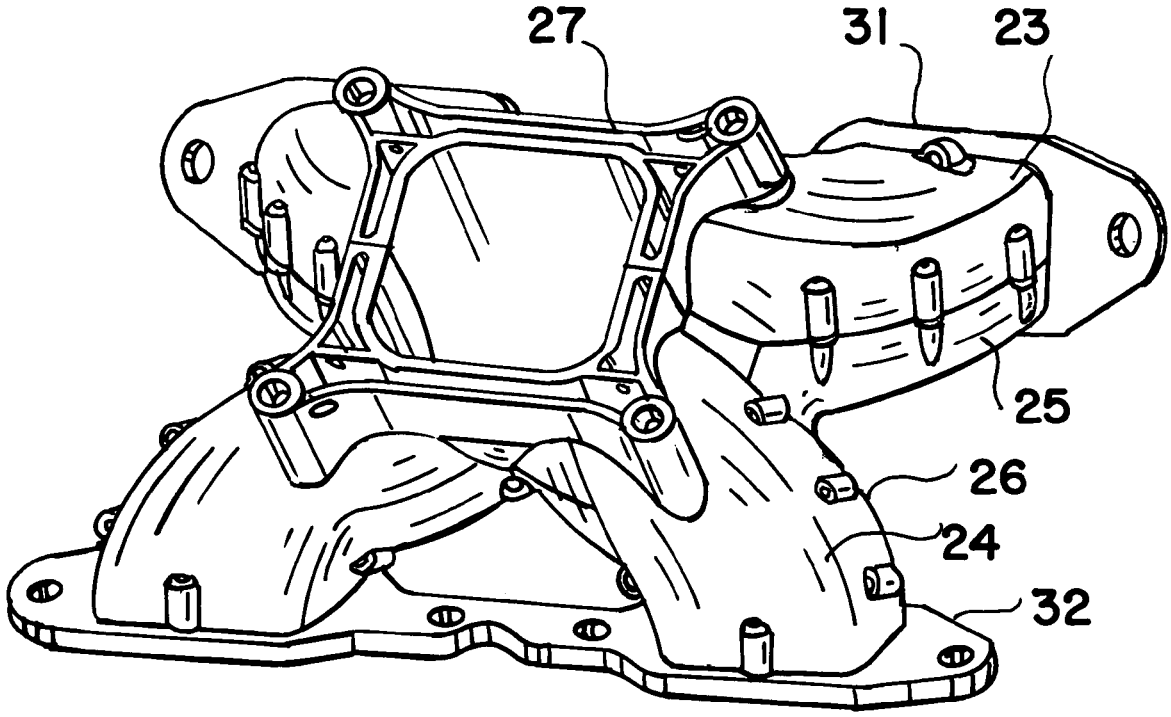
FIG. 5 is yet another isometric rendering of the spider illustrating its complete assembly; and, FIG. 6 is an isometric drawing of the isolator portion of the present invention.

Either or any of the above described construction configurations, provides for a spider 21 having a carburetor flange split in a direction along the longitudinal axis of the engine. Of course, the split exists only before the spider halves are connected to each other. Once sealingly connected together, for all intents and purposes, the split ceases to exist. Conceivably, a two piece spider, or even a four piece spider, can be constructed such that it is split perpendicular to the engine's longitudinal axis. FIG. 5 illustrates a fully assembled spider 21, independent of the isolator 22. The term "spider" is of course an arbitrary term used in the industry to define the flow distribution portion 21 of the intake manifold 22. The term "spider' being selected for no reason other than the somewhat resemblance of the flow distribution portion 21 to an actual spider insect.

Figure 6:
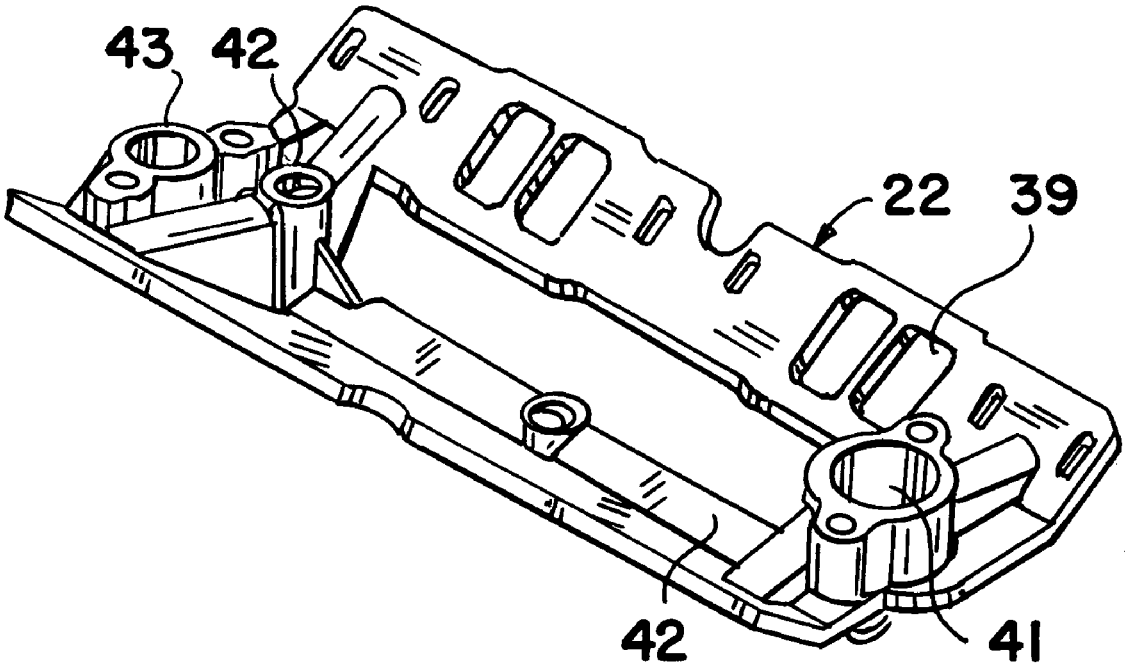

The isolator portion 22 of the inventive intake manifold 10 is seen in FIG. 6. As noted above, the isolator interfaces between the spider 21 and the vee valley 14 of the engine. The isolator 22 serves several important and advantageous functions. In general, however, the isolator includes a plurality of openings 39 along each side thereof that coincide with the openings in the engine that flow connect to the inlet valves of each cylinder and coincide with the fuel outlet openings 29 in the spider 21. This, as seen in FIG. 2, the spider 21 connects directly to the isolator 22 and provides fuel flow communication from the spider passages 28 through the ports 39 of the isolator and into the cylinders. Yet, the spider 21 and the isolator function independent of each other. By way of notation, use of the word "fuel" as used herein actually refers to a mixture of fuel, such as gasoline, and an oxidizer such as air or nitrous oxide, that has been mixed in the carburetor and or the carburetor spacer, attached to the carburetor flange 27 of the spider 21. It is this mixture that is caused to flow through the passages 28 in the spider 21 and into the cylinders where it is burned producing the engine's power.

The isolator 22 also includes an opening 41 that houses the engine cooling fluid thermostat. Coolant flow channels 42 are provided in the isolator 22 that flow connect the thermostat housing 41 with the coolant flow channels in the engine via the vee valley 14 opening. In this manner, the need for overhead coolant piping is eliminated from the vicinity of the intake manifold thereby eliminating a good measure of congestion and allows for much needed access when servicing the carburetor and the intake manifold.

A distributor shaft opening 43 is also provided in or through the isolator 22. The distributor shaft opening 43 allows the distributor shaft that is driven by the crank shaft located deep in the vee valley to pass up and through the isolator 22. A seal is used between the distributor shaft and the distributor shaft opening 43. In this manner, adjustments made to the distributor need not be disturbed or readjusted when one spider 21 of the intake manifold 22 is exchanged for another that can accommodate a different sized carburetor. Thus, the advent of the isolator 22 isolates the distributor settings when changing spiders 21.

As noted above, the isolator 22 substantially blocks the spider 21 from the environment within the valve valley 14. In this manner, the fuel and oxidizer mixture ratio that has been carefully established and the careful mixing of the fuel and oxidizer accomplished by the carburetor and its spacer that flows through the spider 21 passages are also substantially isolated and therefore maintained from the adverse effects of the environment within the vee valley. This is most advantageous in that the fuel oxidizer ratio and mixture which is critical to optimal burning within the cylinders is better able to be maintained notwithstanding its need to travel the path from the carburetor and spacer to the intake of the cylinders. By contrast, in the prior art, the one piece intake manifold necessarily exposes the carefully established fuel mixture ratio and its mixing to the environment of the vee valley which adversely affects the same and the power produced therefrom. This ratio and mixture isolation advantage is one factor that enables an engine equipped with the inventive intake manifold 10 to achieve greater power for a given amount of fuel.

The advantage provided by the inventive intake manifold comprising the ability to change carburetors without disturbing the engine's timing and without disturbing the various oils and water seals associated with the vee valley 14 is a substantial advantage over the prior art. As stated above. to change carburetors, it is only necessary to remove the spider 21 from the isolator 22 and connect a new spider having the carburetor flange sized to fit the new carburetor. It is not necessary to disturb the connection of the isolator to the valve valley. Not only does this capability save time in changing carburetors, it prevents possible engine failure due to inadvertent improper resealing of the vee valley and completely avoids any chance of intermixing the various engine fluids, or even dropping a nut or bolt into the engine. Further it is not necessary to remove and replace the engine thermostat and the associated piping, and it is not necessary to remove and replace the distributor nor to readjust the same. The separate connections between the valve valley and the isolator, and the connection between the spider and the isolator further provides the advantage of breaking up some vibration harmonics that can exist in the prior art because of one piece intake manifold. Eliminating even some possible vibration harmonics prevents such harmonics from disturbing the carefully prepared fuel-oxidizer mixture thereby maintaining consistent power, preventing power losses and preventing power surges.

The isolator 22 as seen in the drawings generally forms a vee that substantially coincides with the vee angle 13 of the engine. Because of this configuration and the sealing provided by the isolator 22 within the vee valley, a lesser space exists within the vee valley. In some instances, engine technicians will cause a vacuum to exist within the valve valley 14. Inasmuch as the unique configuration of the isolator 22 lessens the vee valley space, a lesser amount of power is necessary to create a given amount of vacuum in the valve valley 14.

The engine coolant fluid passages 41 and 42, leading from and to the thermostat port 41 are incorporated within the isolator 22 and are generally located at the approximate apex of the vee formed by the isolator 22. This unique construction again eliminates the need to disturb the coolant fluid flow connections when changing carburetors and also eliminates for external coolant fluid lines.

The material from which the spider 21 and the isolator 22 can be made can include aluminum, magnesium, a plastic composite or any other material suitable for manufacturing purposes and design purposes. In other words, the inventive manifold 10 is not to be limited by a choice of materials.

Yet another advantage of the two part intake manifold is that each part i.e. the spider 21 and the isolator 22 can be independently designed to serve the only those functions of the individual components. For example, the spider 21 need not be concerned with the heat problem that is associated with the isolator 22, the isolator can be designed for maximum heat dissipation without having to consider the heat dissipation capability of the spider 21, the flow passages within the spider can be designed for optimal flow conditions without having to consider any effects from the isolator 22, since each part can be independently designed for strength, the overall weight of the intake manifold 10 is lessened. These are only some examples of the numerous advantages made possible by the inventive manifold 10. Thus, the listed advantages are not intended to be all inclusive. In this regard, other advantages will become apparent to those skilled in the art upon use of the invention as it assumes in practice. For example, it is entirely conceivable that the two piece inventive intake manifold can be used for a carbureted straight or in-line internal combustion engine using the teachings disclosed herein.

In accordance with the above, an embodiment for an improved intake manifold for a vee configured internal combustion engine ray is disclosed that is made in two parts in a manner that separates the carburetor connection and fuel-oxidizer flow channels from a member that connects the manifold to an engine block. The separate components of the disclosed intake manifold provide for a great number of advantages over the prior art one piece intake manifold. First and foremost is the ability of the inventive manifold to provide an instantaneous gain in power output by the engine to which the inventive manifold is applied. Yet another significant advantage of the inventive manifold is the ability to change just the spider portion thereof so as to utilize a different sized carburetor without having to disturb the sundry connections within the valve valley.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the description of the invention and the drawings here appended.

I claim:

1. An intake manifold adapted to be applied to the engine block of an internal combustion engine having a vee configuration, an engine vee valley between opposite banks of pistons and cylinders, and a carburetor attached thereto, said engine block having a longitudinal axis in a direction parallel of the inverted apex of said vee, comprising:

a fuel-oxidizer flow member having an inlet end and a plurality of outlet ends, said inlet and outlet ends being flow connected by internal flow passages, a carburetor flange connected to said inlet end of said fuel-oxidizer flow member, an isolator member removably and sealingly connected on one side to said fuel-oxidizer flow member, and the opposite side being configured to be removably and sealingly connected to said engine vee valley, said isolator member having a plurality of openings therethrough aligned with said plurality of outlet ends of said fuel-oxidizer flow member, said fuel-oxidizer flow member and said carburetor flange, comprising a first portion and a second portion removably and sealingly connected to each other along a line in a direction to the longitudinal axis of the engine and such that said first portion is flow connected to one bank of pistons and cylinders and the second portion is flow connected to the other bank of pistons and cylinders, whereby said internal flow passages are readily accessible for porting and polishing of the same.

2. The apparatus of claim 1 wherein said isolation member is an isolating member that is sealingly and removably connected to said engine vee valley.

3. The apparatus of claim 2 wherein said fuel-oxidizer flow member is removable from said isolating member without disturbing the sealing connection of the isolation member to the engine vee valley.

4. The apparatus of claim 1 wherein said isolation member comprises means to lessen heat transfer from the engine vee valley to the fuel-oxidizer member.

5. The apparatus of claim 1 wherein said isolation member comprises means to lessen vibrations from the engine vee valley to the fuel-oxidizer member.

6. The apparatus of claim 1 wherein said isolation member includes coolant flow channels, said coolant flow channels providing cooling fluid to and from said engine.

7. The apparatus of claim 1 wherein said isolation member includes an opening therethrough adapted to sealingly fit therein a distributor shaft of said engine.

8. The apparatus of claim 6 wherein said isolation member includes a port adapted to sealingly house an engine cooling thermostat therein, said port being flow connected to said coolant flow channels.

9. The fuel-oxidizer flow member of claim 1 wherein the outlet ends of each half portion of said fuel-oxidizer flow member are fixedly connected to each other by a mounting plate said mounting plate being interposed between said outlet ends and said isolator member, and sealingly connected to said isolator member.

10. The fuel-oxidizer flow member of claim 1 wherein said plurality of outlet ends comprise at least two outlet ends on each half portion of said fuel-oxidizer flow member, each of said outlet ends being spaced apart and in line with each other and each of said outlet ends being flow connected to said inlet end by separate flow passageways which merge together at said inlet end.

11. The fuel-oxidizer flow member of claim 9 wherein the flow passageways of each portion of said fuel-oxidizer member comprise a first upper half and a second lower half, said first half including said carburetor flange half of said fuel-oxidizer flow member and said second half including said mounting plate, said first and second halves being sealingly and removably connected to each other such that said first and second halves of said flow passageways are readily accessible for porting and polishing.

12. An intake manifold adapted to be applied to the engine block of an internal combustion engine having a vee configuration, an engine vee valley between opposite banks of pistons and cylinders, and a carburetor attached thereto, comprising:

a fuel-oxidizer flow member having an inlet end with a carburetor flange attached thereto and a plurality of outlet ends, said inlet and outlet ends being flow connected by internal flow passages, an isolator member removably and sealingly connected on one side to said fuel-oxidizer flow member, and die opposite side being adapted to be removably and sealingly connected to said engine vee valley, said isolator member having a plurality of openings aligned with the outlet ends of said fuel-oxidizer flow member, said fuel-oxidizer flow member and said carburetor flange, comprising a first portion and a second portion removably and sealingly connected to each other along a longitudinal line of said engine block such that said first portion is flow connected to one bank of pistons and cylinders and the second portion is flow connected to the other bank of pistons and cylinders, wherein the outlet ends of each half portion of said fuel-oxidizer flow member are fixedly connected to each other by a mounting plate said mounting plate being interposed between said outlet ends and said isolator member, and sealingly connected to said isolator member, wherein the flow passageways of each portion of said fuel-oxidizer member comprise a first upper half and a second lower half, said first half including said carburetor flange half of said fuel-oxidizer flow member and said second half including said mounting plate, said first and second halves being sealingly and removably connected to each other such that said first and second halves of said flow passages are readily accessible for porting and polishing.

13. The combination of claim 12 wherein said fuel-oxidizer flow member is removably connected to said isolation member without disturbing the connection of the isolation member to the engine vee valley.

14. The combination of claim 12 including a spacer between said carburetor and said carburetor flange.

15. The combination of claim 12 including engine coolant flow channels within said isolator and includes a port adapted to sealingly house an engine cooling thermostat therein, said port being flow connected to said coolant flow channels.

16. The combination of claim 12 wherein said isolation member includes an opening therethrough adapted to sealingly fit therein a distributor shaft of said engine.

17. The apparatus of claim 12 wherein said fuel-oxidizer member comprises two halves, each being a mirror image of the other, that are sealingly connected, each half delivering fuel and oxidizer to a respective one of said set of pistons and cylinders on one leg of the vee of the engine.

18. The apparatus of claim 12 wherein said isolator member comprises means to lessen heat transfer from the engine vee valley to the fuel-oxidizer member.

* * * * *